US007527049B2

(12) United States Patent
Sheng

(10) Patent No.: US 7,527,049 B2
(45) Date of Patent: May 5, 2009

(54) PNEUMATIC PUSHER

(76) Inventor: Chih-Sheng Sheng, No. 100, Tzu Chiang W. Road, Kweishan Hsiang, Tao-Yuan Hsien (TW)

( * ) Notice: Subject to any disclaimer, the term of this patent is extended or adjusted under 35 U.S.C. 154(b) by 633 days.

(21) Appl. No.: 11/289,287

(22) Filed: Nov. 30, 2005

(65) Prior Publication Data

US 2007/0119988 A1 May 31, 2007

(51) Int. Cl.
*F41B 11/00* (2006.01)

(52) U.S. Cl. ..... 124/73; 124/75

(58) Field of Classification Search ..... 124/73, 124/74, 75, 76, 77
See application file for complete search history.

(56) References Cited

U.S. PATENT DOCUMENTS 5,613,483 A * 3/1997 Lukas et al. ..... 124/73
5,778,868 A * 7/1998 Shepherd ..... 124/76
6,601,780 B1 * 8/2003 Sheng ..... 239/337
6,925,997 B2 * 8/2005 Sheng ..... 124/74
7,299,796 B2 * 11/2007 Kirwan ..... 124/71
2003/0005918 A1 * 1/2003 Jones ..... 124/70
2008/0127960 A1 * 6/2008 Gan ..... 124/75

* cited by examiner

*Primary Examiner*—Troy Chambers
*Assistant Examiner*—Gabriel J Klein
(74) *Attorney, Agent, or Firm*—Rosenberg, Klein & Lee

(57) ABSTRACT

A pneumatic pusher having a main body, a flow-guiding body, a moving body, and a delivery tube. The flow-guiding body includes a front tube with a smaller diameter and a rear tube with a larger diameter. The delivery tube is mounted on the front tube in such a way that the outer wall of the delivery tube and the inner wall of the main body define a return pressure chamber. A first gas-distributing channel extending from a first air outlet at one side of the main body leads directly to the inner side of the delivery tube. The side of the first air inlet of the main body communicates with a second gas-distributing channel. The second gas-distributing channel includes an exit located at one side of the return pressure chamber of the delivery tube. The air pressure provided through the second gas-distributing channel serves as cushioning force in pushing the delivery tube outwardly. When the moving plunger blocks the gas distributing chamber in such a way that the gas is stopped to be injected through the first gas distributing channel into the pushing chamber for bringing the delivery tube forward, the gas pressure injected through the second gas distributing channel into the return pressure chamber acts as inward return force for the delivery tube. Therefore, the reciprocating movement of the delivery tube on the front tube can be completely done by the airflow.

6 Claims, 9 Drawing Sheets

PNEUMATIC PUSHER

BACKGROUND OF THE INVENTION

1. Field of the Invention

The invention relates to a pneumatic pusher, and more particularly to a pneumatic pusher that allows a change of the flow field pressure by controlling an airflow channel in an open and a close state. Accordingly, an object to be discharged can be pushed forward in a pneumatic manner. The pneumatic pusher is primarily applied to the paintball guns. However, it should not be limited thereto.

2. Description of the Related Art

Most of the paintball guns employ a mechanic pusher to control the discharge of the paintball. However, it contains a great number of mechanic components, thereby resulting in the rise of the failure rate. Meanwhile, the discharge speed will be considerably restricted.

The inventor of the present invention has disclosed a "PAINTGUN WITH PENUMATIC FEEDING AND DISCHARGING PROCESS" in U.S. Pat. No. 6,601,780and pub.No:US2005/005924A1 in which the paintballs are discharged in a pneumatic manner for improving the operation safety, reducing the failure rate and increasing the discharge speed.

However, a return spring has to be mounted on a front part of a delivery tube in the above-mentioned disclosure. The return spring is utilized to apply a restoring force to the delivery tube. People make higher and higher demands on the discharge speed of the paintball gun, like twenty paintballs per second. After prolonged service, the return spring will create fatigue in elasticity, thereby resulting in decrease of the discharge speed. However, the pneumatic pushing force acting on the delivery tube remains unchanged. Thus, the reciprocating process of the delivery tube becomes problematic due to mismatch in speed. Accordingly, a smooth and quick discharge process of the paintball gun will be considerably affected.

Meanwhile, the front end of the delivery tube lacks an elastic rubber ring such that the front end of the delivery tube made of metal will be in direct contact with the paint ball and therefore causes an easy burst of the paint ball.

In addition, it is not possible for the aforementioned disclosure to adjust the reciprocating process of a flow-guiding piston within a flow-guiding body and therefore to change the flow field pressure.

In view of the foregoing shortcomings of the prior art, the inventor of the present invention conducted extensive experiments and tests to overcome the shortcomings and to achieve the desired discharge speed.

SUMMARY OF THE INVENTION

A primary object of the invention to provide a pneumatic pusher that eliminates the drawbacks of the return spring in the above-mentioned disclosure and ensures a reliable reciprocating displacement of the delivery tube, thereby resulting in a smooth pneumatic pushing action, a decrease of the failure rate, and an improvement of the discharge speed.

Another object of the present invention to provide a pneumatic pusher that is provided with a rubber ring at the front end of the delivery tube for reducing the impact force acting on the object to be discharged.

A further object of the present invention to provide a pneumatic pusher that is provided with a bolt for adjusting the reciprocating action of the moving body, thereby ensuring a convenient control over the change of the flow field pressure.

BRIEF DESCRIPTION OF THE FIG.S

DETAILED DESCRIPTION OF THE PREFERRED EMBODIMENT

Figure 1:
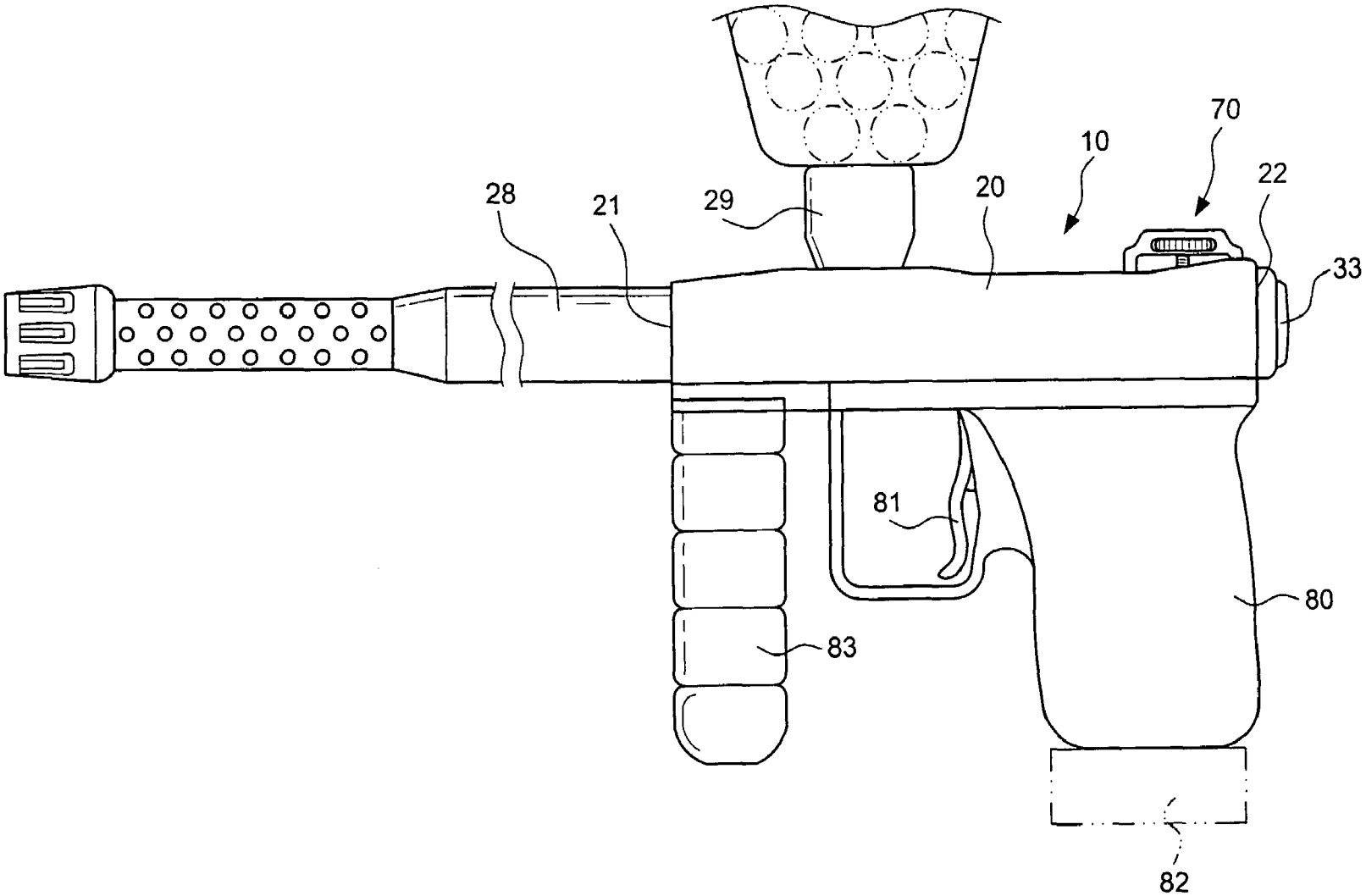
FIG. 1 is a schematic drawing of an embodiment of the invention applied to a paintball gun.

Referring to FIG. 1, a pneumatic pusher 10 in accordance with the present invention is applied to a paintball gun. However, the application should not be limited thereto. In other words, the pneumatic pusher 10 can be employed for BB guns, nailing guns, etc. The paintball gun is taken as example in the following description.

Figure 2:
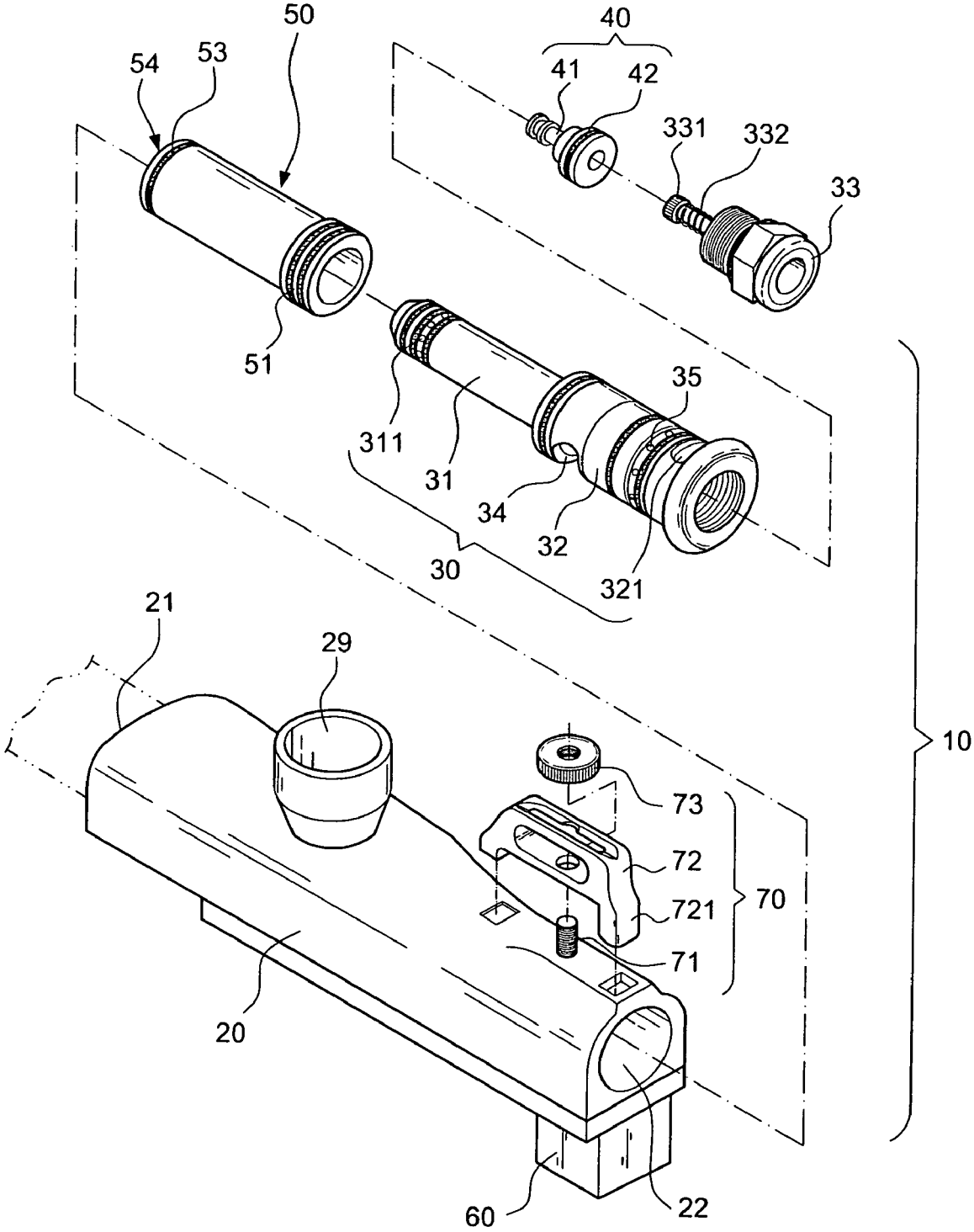
FIG. 2 is a perspective exploded view of the invention.
Figure 3:
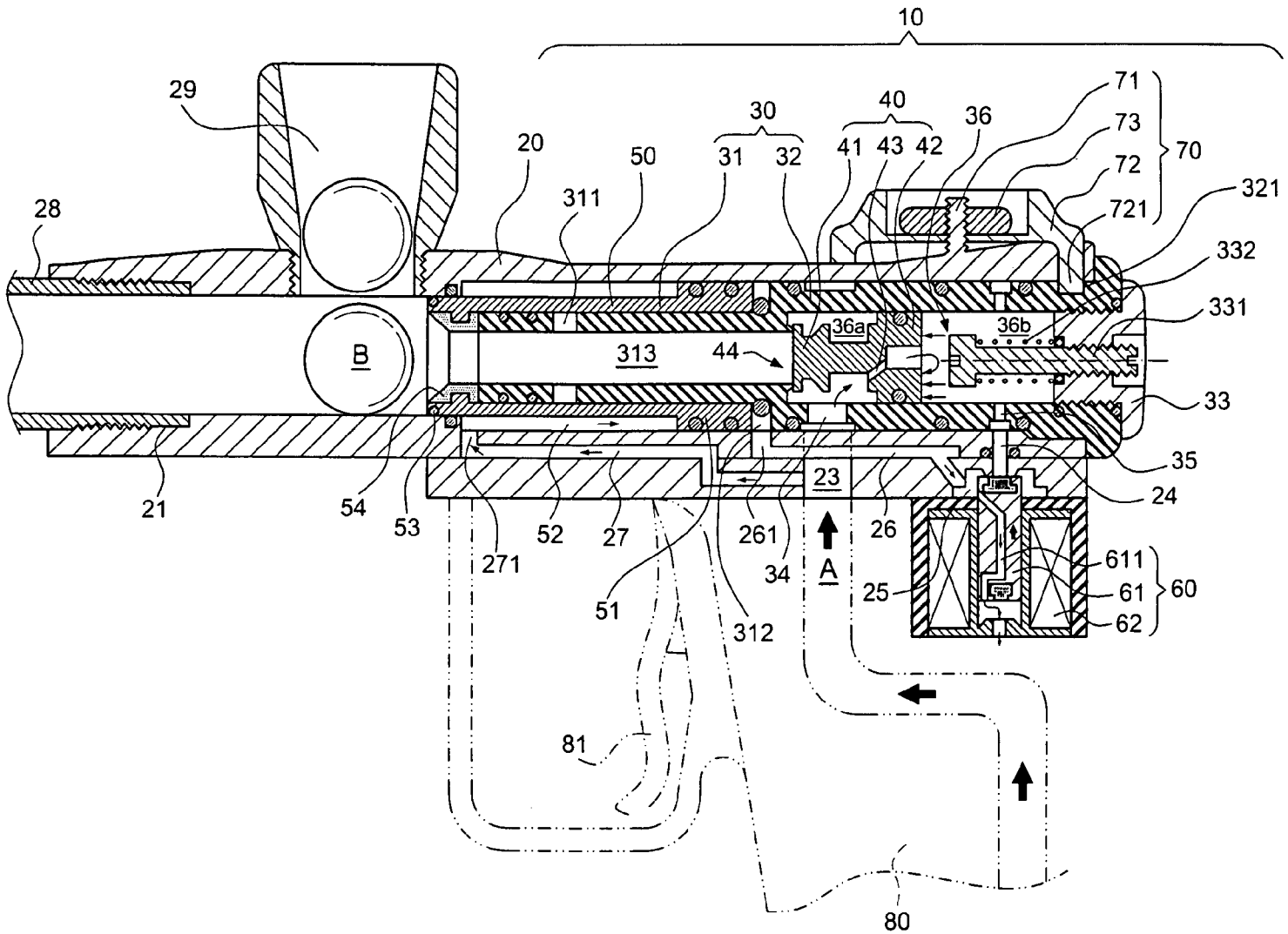
FIG. 3 is a cutaway view of the invention in an initial state.

As shown in FIGS. 2 and 3, the pneumatic pusher 10 in accordance with the invention includes a main body 20, a flow-guiding body 30, a moving body 40, and a delivery tube 50.

The main body 20 includes a hollow tube configuration with a first orifice 21 and a second orifice 22 at both ends thereof. The side of the main body 20 includes a first air inlet 23 for injecting an external pressurized gas A and a first air outlet 24 for guiding the air flow. The first air outlet 24 externally communicates with a gas-distributing chamber 25. The gas-distributing chamber 25 is controlled by a moving plunger 61 in an open or a close state. The side of the gas-distributing chamber 25 includes a first gas distributing channel 26 extending into a hollow tube at the center of the main body 20. The pressurized gas A, as shown in FIG. 1, is delivered via a gas pipe 82 in a handle 80 into the main body 20. The air pressure is obtained from an air pressure bottle or other pneumatic devices. The front side of the handle 80 is provided with a trigger 81 and a second handle 83. The second handle 83 allows a position adjustment in horizontal direction. This does not belong to the object of the invention so that no further descriptions are given hereinafter.

The flow-guiding body 30 is axially inserted via the second orifice 22 into the main body 20 and held by a fixing unit 70 in place. The flow-guiding body 30 includes a front tube 31 with a smaller diameter and a rear tube 32 with a larger diameter. The wall of the front tube 31 is provided with at least one gas hole 311 while an end cap 33 is attached to the rear end of the rear tube 32. The wall of the flow-guiding body 30 includes a second air inlet 34 and a second air outlet 35 corresponding to the first air inlet 23 and the first air outlet 24 of the main body 20, respectively. In the way, the inner wall of the rear tube 32 defines a flow-guiding chamber 36, while the outer wall of the front tube 31 defines a pushing chamber 312 that is located at a position corresponding to an exit 261 of the first gas-distributing channel 26.

A moving body 40 is disposed within the rear tube 32 of the flow-guiding body 30. The front part of the moving body 40 is slim while the rear part thereof is wide. An air valve 41 blocking the mouth of the front tube 31 is formed at the front end of the moving body 40 while a piston 42 dividing the flow-guiding chamber 36 into a front and a rear air pressure chamber 36*a*, 36*b*is tightly fitted within the rear tube 32. The front and the rear air pressure chamber 36*a*, 36*b* have different pressure areas. A small airflow channel 43 is formed between the front and the rear air pressure chamber 36*a*, 36*b* so that the air pressure chambers 36*a*, 36*b* isolated from each other can be communicated by the small airflow channel 43.

The delivery tube 50 is mounted and movable on the front tube 31. The rear end of the delivery tube 50 includes a flange 51 tightly fitting within the main body 20.

The periphery part in prior to the flange 51 of the delivery tube 50 and the inner wall of the main body 20 define a return pressure chamber 52 corresponding to the pushing chamber 312 within the main body 20.

The side of the first air inlet 23 of the main body 20 communicates with a second gas-distributing channel 27. The second gas distributing channel 27 includes an exit 271 located at one side of the return pressure chamber 52 of the delivery tube 50. The air pressure provided through the second gas distributing channel 27 serves as cushioning force in pushing the delivery tube 50 outwardly. When the moving plunger 61 blocks the gas distributing chamber 25 in such a way that the gas is stopped to be injected through the first gas distributing channel 26 into the pushing chamber 312 for bringing the delivery tube 50 forward, the pushing force is reduced. In this way, the gas pressure injected through the second gas-distributing channel 27 into the return pressure chamber 52 is larger than the above-mentioned pushing force and acts as inward return force for the delivery tube 50. Therefore, the reciprocating movement of the delivery tube 50 on the front tube 31 can be completely done by the airflow.

The above-mentioned fixing unit 70 includes a bolt 71 mounted on the main body 20, a yoke 72 disposed on the bolt 71, and a nut 73. The nut 73 is tightened on the bolt 71 for engaging a longer arm 721 of the yoke 72 into a groove 321 of the flow-guiding body 30 such that the flow-guiding body 30 can be locked in the main body 20. In removing the flow-guiding body 30, the nut 73 can be loosened for pulling the yoke 72 upward in such a way that the longer arm 721 of the yoke 72 is released from the groove 321. Accordingly, the flow-guiding body 30 can be axially pulled outwardly. However, the fixing unit 70 should not be limited thereto. Other fixing equivalents are also applicable.

The center of the end cap 33 includes a through hole through which a length-adjustable bolt 331 is inserted. An O-ring, a washer and a spring 332 is mounted on an end of the bolt 331 facing the flow-guiding chamber 36. The length of the bolt 331 extending in the end cap 33 can be adjusted by turning the outside end of the bolt 331. Alternatively, the adjustment can be done before the end cap 33 fits into the flow-guiding chamber 36.

The front end of the delivery tube 50 is externally provided with an O-ring 53 with which the delivery tube 50 tightly fits within the main body 20. In this way, the return pressure chamber 52 is brought into airtight state. A rubber ring 54 made of elastic rubber is disposed on the inner wall at the front opening of the delivery tube 50 for reducing the direct impact force acting on the paintball B and therefore preventing it from coming apart.

The aforementioned moving plunger 61 can be a control element of solenoid valve 60. However, it should not be limited thereto. In other words, the moving plunger 61 is constructed as a moving iron core at the center of the solenoid valve 60. In this way, the moving plunger 61 can be controlled in an extended or a retracted position by applying electric current to a coil 62 of the solenoid valve 60 or not. Therefore, the gas-distributing chamber 25 and the first air outlet 24 can be brought in a close or an open state. The moving plunger 61 in accordance with the invention works in collaboration with the solenoid valve 60. Of course, the moving plunger 61 can be manually operated as well.

Moreover, the bottom of the main body 20 is provided with the handle 80 and the trigger 81 controlling the start or stop of the solenoid valve 60. An extension pipe 28 fits within the first orifice 21 at the front end of the main body 20. In addition, the top of the main body 20 includes a feeding port 29 adjacent to the front end of the delivery tube 50. These all are necessary elements for the paintball gun and have been described in the prior case so that no further descriptions are given hereinafter.

The invention is primarily characterized in the return pressure chamber 52 between the delivery tube 50 and the main body 20 as well as the second gas-distributing channel 27. By use of this design, the drawback of the return spring employed in the prior art can be eliminated. The operation of the pneumatic pusher 10 in accordance with the invention will be depicted in collaboration with FIGS. 3 through 9 as follows:

FIG. 3 shows an initial state of the pneumatic pusher 10. In this state, the entrance of the gas-distributing chamber 25 is closed by the moving plunger 61. The pressurized gas A is introduced from the first air inlet 23 of the main body 20 via the second air inlet 34 of the flow-guiding body 30 into the flow-guiding chamber 36 of the rear tube 32. Then, the gas passes through the small airflow channel 43 and enters into the rear air pressure chamber 36*b*. The air valve 41 will be shifted forward and forced against the mouth of the front tube 31 since the area of pressure of the rear air pressure chamber 36*b* acting on the piston 42 is larger than the supported area 44 of the air valve 41. In this way, the gas is prevented from being escaped from a main gas channel 313 within the front tube 31. Meanwhile, the gas is supplied from the first air inlet 23 through the second gas-distributing channel 27 and injected via the exit 271 into the return pressure chamber 52. Thus, the delivery tube 50 is brought in a retracted position.

Figure 4:
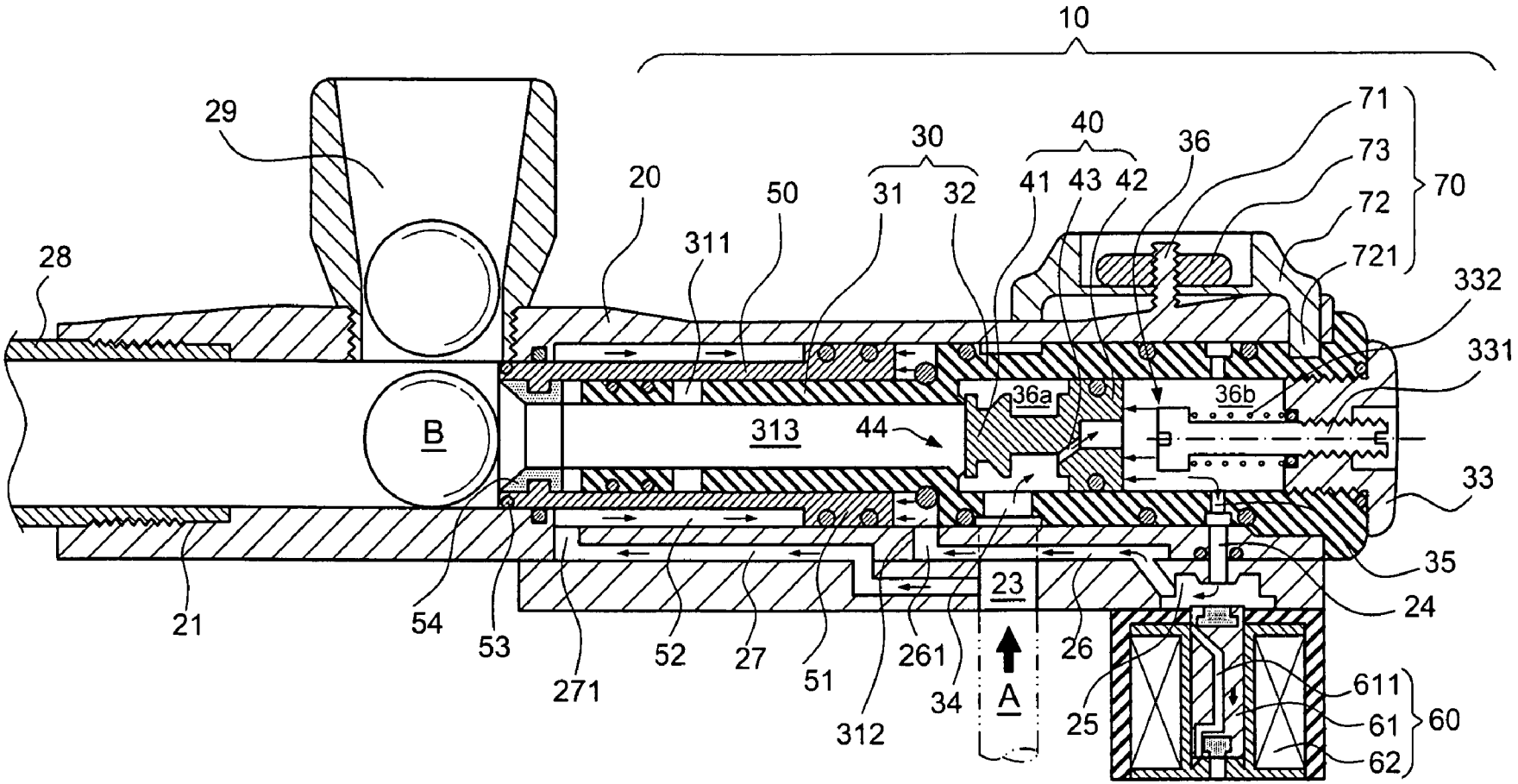
FIG. 4 is a cutaway view of the invention showing a moving plunger in an open position.

Thereafter, as shown in FIG. 4, the moving plunger 61 is moved downward by means of the activation of the trigger 81, thereby opening the airflow channel of the gas-distributing chamber 25. At that time, the pressurized gas within the rear air pressure chamber 36*b* flows through the second air outlet 35 and the first air outlet 24 into the gas distributing chamber 25 and then is forced through the first gas distributing channel 26 against the inner side of the flange 51 of the delivery tube 50. In other words, the pressurized gas is entered into the pushing chamber 312 at the inner end of the front tube 31. This pressurized gas allows the forward movement of the delivery tube 50 for pushing the paintball B falling from the feeding port 29 slightly forward. The volume of the pushing surface of the delivery tube 50 is smaller than the rear air pressure chamber 36*b*. Moreover, only a small amount of pressurized gas is fed through the small airflow channel 43 into the rear air pressure chamber 36*b*. In this way, the forward pressure acting on the piston 42 is still larger than the pressure acting on the supported area 44 of the air valve 41. Thus, the air valve 41 remains still.

Figure 5:
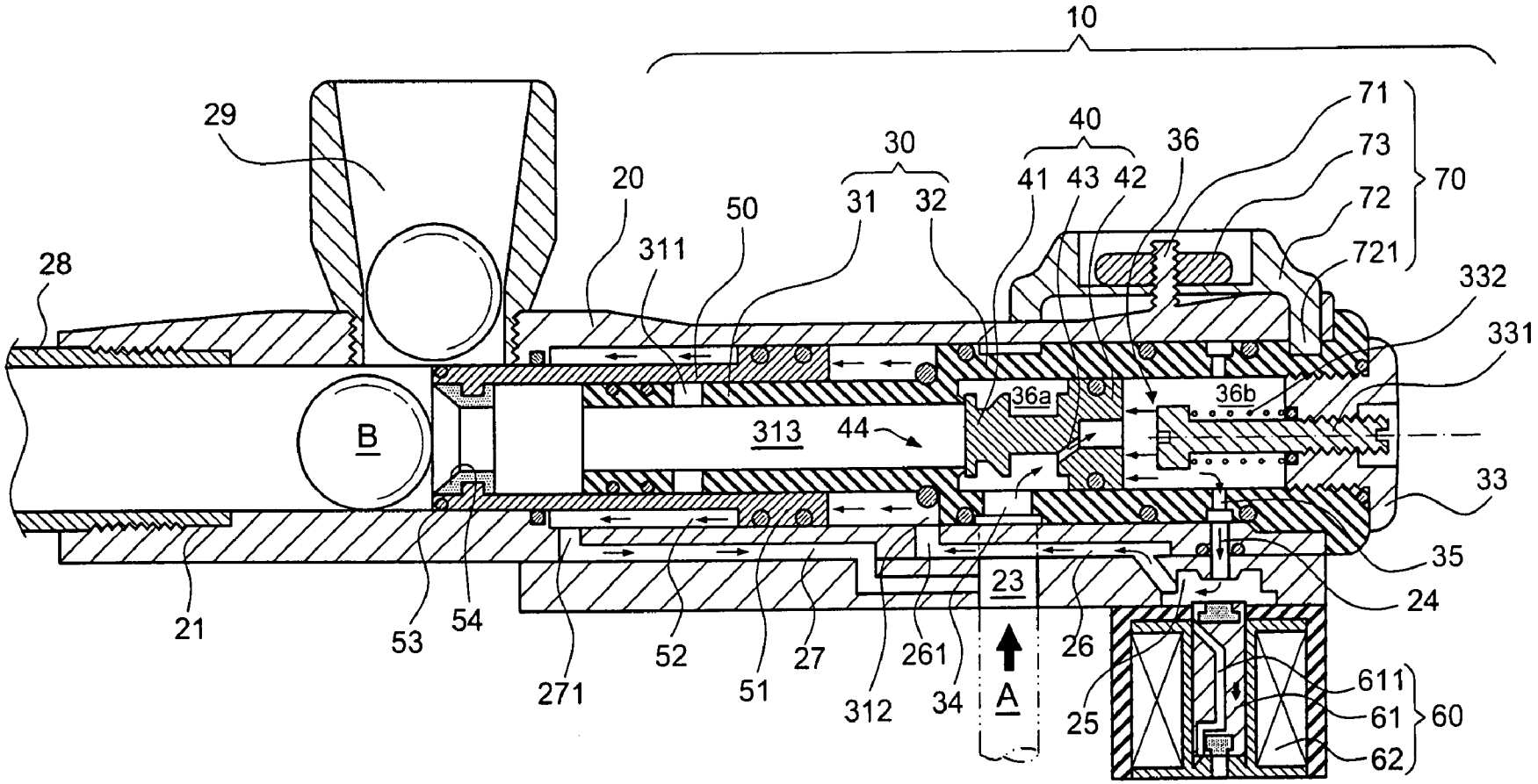
FIG. 5 is a cutaway view of the invention showing that a small amount of airflow is injected through a first gas distributing channel to enable the forward movement of the delivery tube.
Figure 6:
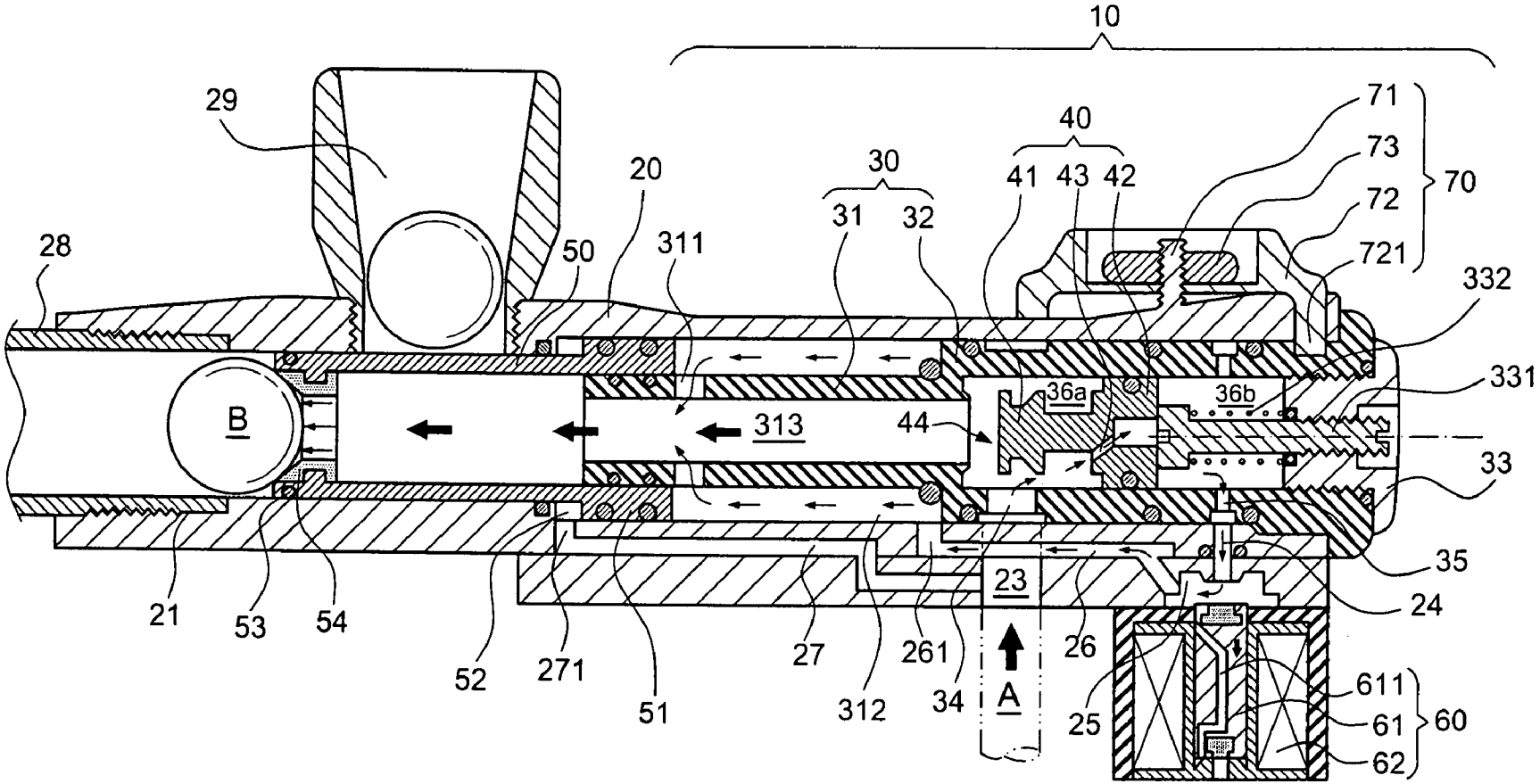
FIG. 6 is a cutaway view of the invention showing that a stream of gas forcefully shoots forth through the main gas channel for discharging the paintball.

As shown in FIG. 5, the inner area of the flange 51 of the delivery tube 50 is larger than the outer area of the return pressure chamber 52 so that the pushing force acting on the internal pushing chamber 312 is larger than the external action force. Therefore, the delivery tube 50 is gradually pushed forward by the airflow within the pushing chamber 312 to the gas holes 311 of the front tube 31. As shown in FIG. 6, the airflow is injected from the gas holes 311 into the front tube 31. The small airflow channel 43 is so small that the supplied gas cannot fill the rear air pressure chamber 36*b*, thereby resulting in the change of the flow-field pressure. At this moment, the pressure of the rear air pressure chamber 36*b* is reduced while the pressure of the front air pressure chamber 36*a* becomes larger than that of the rear air pressure chamber 36*b*. Consequently, the air valve 41, as shown in FIG. 6, is moved backward and separated from the inlet of the main gas channel 313. In this way, a great amount of gas is jetted through the main gas channel 313 into the delivery tube 50, thereby discharging the paintball B that has been slightly brought forward at the front end of the delivery tube 50.

Figure 7:
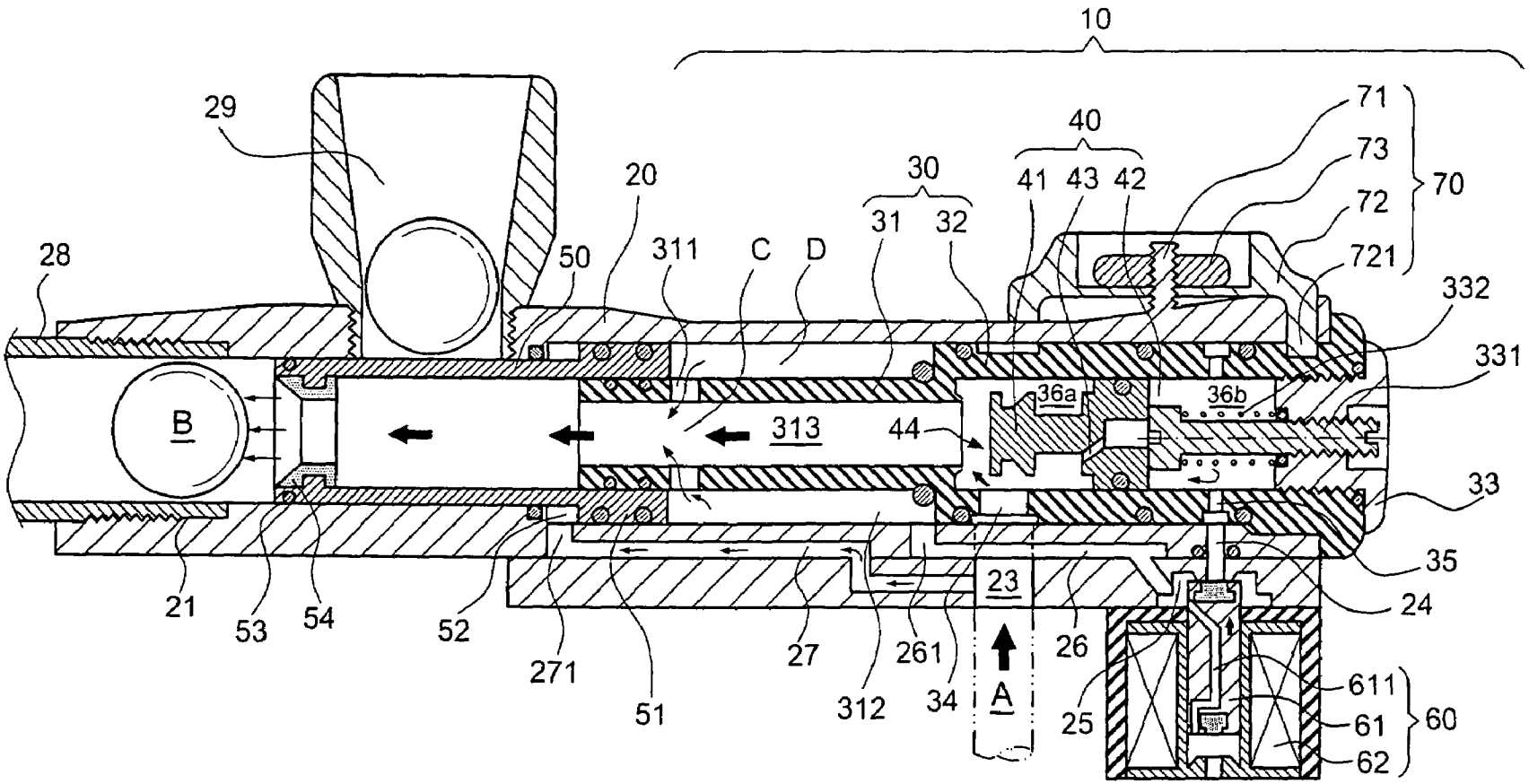
FIG. 7 is a cutaway view of the invention showing the moving plunger in an open position.

Furthermore, as shown in FIG. 7, the moving plunger 61 is moved upward to close the airflow channel of the gas distributing chamber 25, thereby resulting in another change in the flow-field pressure. That is, the return pressure begins to be created in the rear air pressure chamber 36*b*. When a stream of gas forcefully shoots forth through the main gas channel 313, the periphery C corresponding to the gas holes 311 creates a suction effect upon the gas within an area D of the main body 20 according to hydromechanics. Accordingly, the area D is brought into a half-vacuum state, thereby reducing the resistance in restoring the delivery tube 50. At this moment, the gas continues to be fed via the second gas-distributing channel 27 into the return pressure chamber 52. Thus, the gas within the return pressure chamber 52 acts as a return spring to restoring the delivery tube 50 in the direction of the internal side (see FIG. 8). Now, the pressure area in the rear air pressure chamber 36*b* is larger than the supported area 44 of the air valve 41 within the front air pressure chamber 36*a*. Accordingly, the operational process goes back to the initial state again.

The present invention primarily differs from the prior case in that the gas is injected through the second gas-distributing channel 27 into the return pressure chamber 52 to fulfill the function of the return spring employed in the prior case without the disadvantages thereof. Of course, the return spring (not shown) may be also installed within the return pressure chamber 52 to create the thrust in collaboration with the pressurized gas within the return pressure chamber 52 for restoring the delivery tube 50. Details thereabout won't be given hereinafter.

Figure 8:
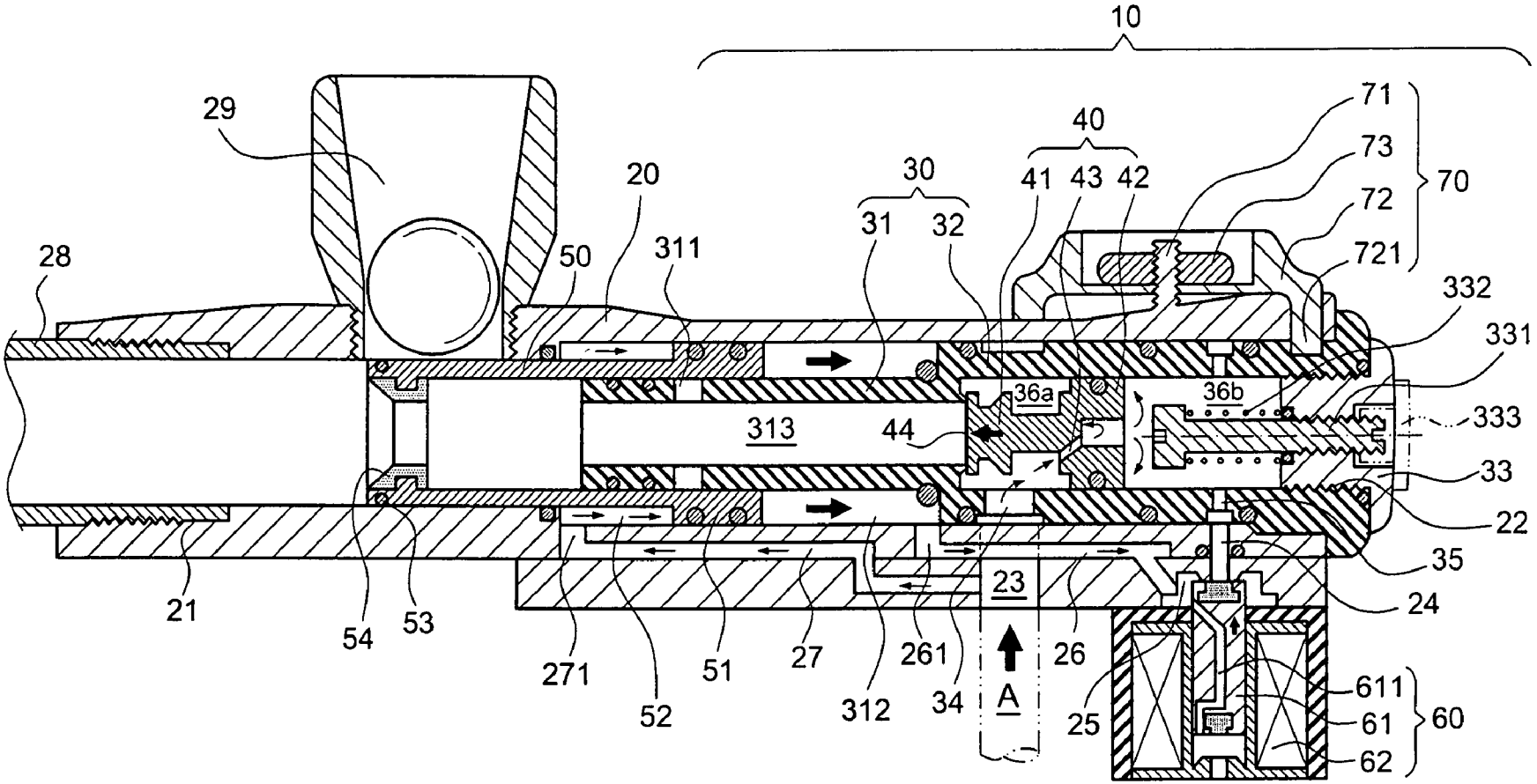
FIG. 8 is a cutaway view of the invention showing the moving action of the moving body.
Figure 9A:
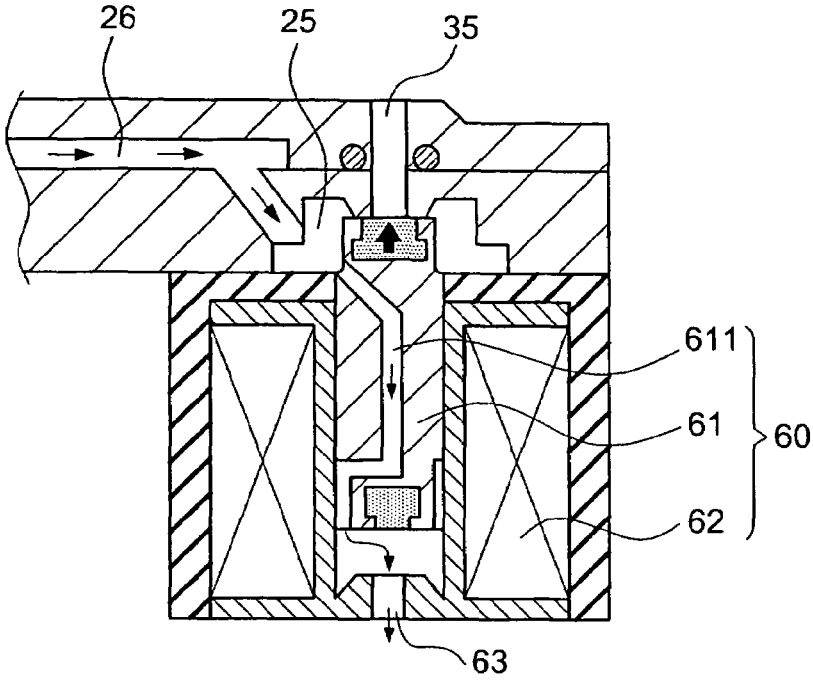
FIGS. 9A and 9B are cutaway views of a solenoid valve in an open and a close state.
Figure 9B:
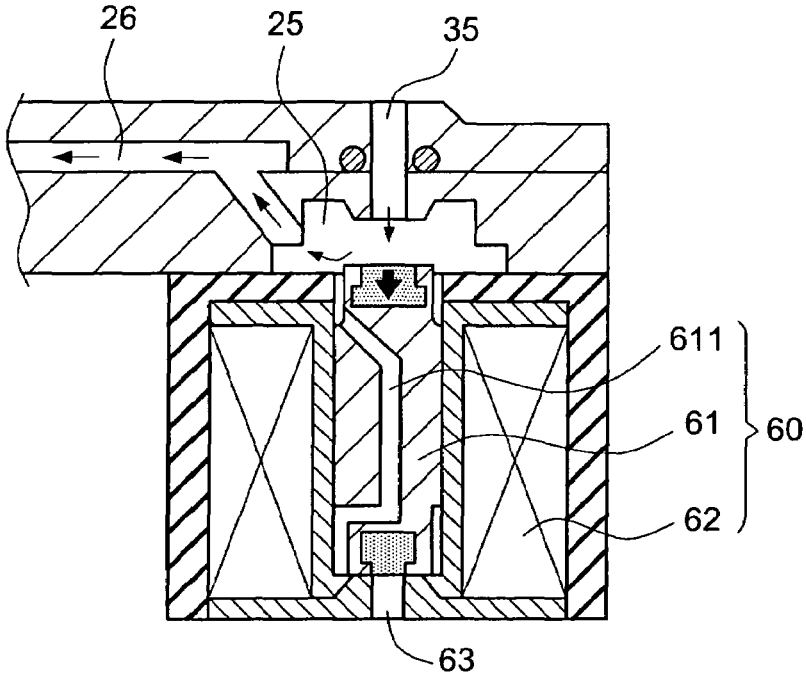

Furthermore, as shown in FIGS. 8 and 9A, the airflow within the pushing chamber 312 begins to escape via the first gas distributing channel 26 and a pressure-relief channel 611 out of the pneumatic pusher 10, thereby ensuring a smooth restoring action of the delivery tube 50 when the moving plunger 61 is moved upward to close the second air outlet 35. FIG. 9B shows an enlarged view of the moving plunger 61 that is moved downward. Corresponding to FIGS. 4 through 6, the pressure-relief channel 611 is closed so that the gas is introduced from the gas-distributing chamber 25 directly into the first gas-distributing channel 26.

The other principles and structure of the invention haven been described in the prior case and do not belong to the object of the invention so that no further descriptions are given hereinafter.

By the way, the rubber ring 54 installed at the front end of the delivery tube 50 can prevent the paintball B from coming apart. Meanwhile, the end cap 33 includes the bolt 331 for controlling the reciprocating movement of the moving body 40. These all make the prior case more complete and practical.

In addition, as shown in FIG. 8, an adjusting knob 333 is fitted to the end cap 33 for directly controlling the position of the bolt 331, thereby ensuring a more easy adjustment of the discharge speed of the paintball B.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A pneumatic pusher, comprising:

a) a main body having a hollow tube configuration with a first orifice and a second orifice at both ends thereof, a side of the main body having a first air inlet for injecting an external pressurized gas and a first air outlet for guiding the air flow, the first air outlet externally communicating with a gas distributing chamber, the gas distributing chamber being controlled by a moving plunger in an open or a close state, a side of the gas distributing chamber including a gas distributing channel extending into a hollow tube at the center of the main body;

b) a flow-guiding body axially inserted via the second orifice into the main body and held by a fixing unit in place, the flow-guiding body including a front tube having a first diameter and a rear tube having a second diameter, wherein the first diameter is smaller than the second diameter, a wall of the front tube being provided with at least one gas hole, an end cap being attached to a rear end of the rear tube, the wall of the flow-guiding body including a second air inlet and a second air outlet corresponding to the first air inlet and the first air outlet of the main body, respectively, an inner wall of the rear tube defining a flow-guiding chamber, an outer wall of the front tube defining a pushing chamber that is located at a position corresponding to an exit of the first gas distributing channel;

c) a moving body disposed within the rear tube of the flow-guiding body, a front part of the moving body being slimmer than a rear part thereof, an air valve blocking a mouth of the front tube being formed at the front end of the moving body, a piston dividing the flow-guiding chamber into a front and a rear air pressure chamber being tightly fitted within the rear tube, the front and the rear air pressure chamber having different pressure areas, a small airflow channel being formed between the front and the rear air pressure chamber so that the air pressure chambers isolated from each other may be communicated by the small airflow channel; and d) a delivery tube mounted and movable on the front tube, a rear end of the delivery tube including a flange tightly fitting within the main body, wherein a periphery part of a portion of the delivery tube forward of the flange and the inner wall of the main body define a return pressure chamber, and wherein a side of the first air inlet of the main body communicates with a second gas distributing channel, and the second gas distributing channel includes an exit located at one side of the return pressure chamber of the delivery tube, wherein pressurized gas through the second gas distributing channel serves to provide a cushioning force in pushing the delivery tube, and wherein, when the moving plunger blocks the gas distributing chamber in such a way that gas supplied from an external source is prevented from being injected through the first gas distributing channel into the pushing chamber for bringing the delivery tube forward, wherein pressurized gas injected through the second gas distributing channel into the return pressure chamber acts to provide an inward return force for the delivery tube; accordingly, the reciprocating movement of the delivery tube on the front tube can be completely done by the air flow.

2. The pneumatic pusher as recited in claim 1 wherein a fixing unit includes a bolt mounted on the main body, a yoke disposed on the bolt, and a nut, and wherein the nut is tightened on the bolt for engaging a longer arm of the yoke into a groove of the flow-guiding body.

3. The pneumatic pusher as recited in claim 1 wherein the end cap includes a bolt for controlling the reciprocating movement of the moving body within the rear tube.

4. The pneumatic pusher as recited in claim 1 wherein the front end of the delivery tube is externally provided with an O-ring, and wherein a rubber ring is disposed on an inner wall at the front opening of the delivery tube.

5. The pneumatic pusher as recited in claim 1 wherein the moving plunger includes a solenoid valve, and a pressure-relief channel is formed within the moving plunger.

6. The pneumatic pusher as recited in claim 5 wherein the bottom of the main body is provided with a handle and a trigger controlling the start or stop of the solenoid valve, and wherein an extension pipe fits within the first orifice at the front end of the main body, and wherein the top of the main body includes a feeding port adjacent to the front end of the delivery tube.

* * * * *